United States Patent [19]

Dalton, Jr.

[11] 4,347,659

[45] Sep. 7, 1982

[54] METHOD OF MAKING STICK WOUND COILS

[75] Inventor: Richard L. Dalton, Jr., West Bend, Wis.

[73] Assignee: Tecumseh Products Company, Tecumseh, Mich.

[21] Appl. No.: 131,258

[22] Filed: Mar. 17, 1980

[51] Int. Cl.[3] ..... H01F 41/10

[52] U.S. Cl. ..... 29/605; 29/418

[58] Field of Search ..... 29/605, 602 R, 418; 336/192

[56] References Cited

U.S. PATENT DOCUMENTS

| | | | |
|---|---|---|---|
| 1,142,027 | 6/1915 | Da Costi | 336/192 |
| 1,625,465 | 4/1927 | Grant | 29/605 X |
| 1,833,221 | 11/1931 | Leidy | 29/605 |
| 2,706,280 | 4/1955 | Gntto et al. | 29/605 X |
| 3,277,417 | 10/1966 | Rechel | 29/605 X |
| 3,278,880 | 10/1966 | Lewis et al. | 29/605 |
| 3,373,390 | 3/1968 | Rechel | 29/605 X |

*Primary Examiner*—Carl E. Hall

*Attorney, Agent, or Firm*—Albert L. Jeffers; Roger M. Rickert

[57] ABSTRACT

An arrangement whereby a plurality of coils may be simultaneously formed on a common coil form and thereafter that form sliced or sectioned to yield individual coils is disclosed employing an elongated hollow coil form of insulating material with a plurality of lateral surface openings spaced therealong and extending in the direction of elongation. A conductive strip extends along the surface of the coil form and has a plurality of conductive tabs extending from the strip and through corresponding coil form openings into the hollow interior of the form. A plurality of wire ends are attached to the conductive strip and the coil form rotated to generate the plurality of coils thereon. A second conductive strip may be placed along the formed coils for terminating the other coil lead so that when individual coils are severed from the form, convenient terminals connected to the beginning and terminus of the coil are available for connecting the coil in circuit with other components.

14 Claims, 4 Drawing Figures

METHOD OF MAKING STICK WOUND COILS

BACKGROUND OF THE INVENTION

The present invention relates generally to the art of forming coils of conductive wire and more particularly to the concurrent forming of a plurality of such coils of wire about a rotating coil form.

A wide variety of techniques for winding coils are known. In some cases, one end of a wire is fastened to a coil form and then that form is rotated to form the turns of wire on the coil form. In other cases, the wire is dispensed from a so-called flyer with that flyer rotating about a coil form to generate the wire turns thereon. In some cases, wire is dispensed directly to a coil form where that wire will remain when the coil is utilized, while in other cases an intermediate coil form initially receives the wire with the coil thereafter being transferred to its final location. The present invention is concerned with winding schemes where the coil is generated about a coil form on which the coil will remain throughout its useful life, however, the manner in which the turns are generated, that is by a rotating flyer or by revolving the coil form, is immaterial to the present invention.

An exemplary environment in which the present invention finds particular utility is the production of ignition coils, such as secondary coils employing a relatively large number of turns of relatively fine wire which are frequently formed on a tubular insulator and often employ winding layers separated by insulating paper or the like.

The prior art approach to winding such exemplary ignition coils was to provide a winding tube of insulating material, such as cardboard, about which a plurality of such coils were to be formed, and attaching individual lead wires to the start lead of the wire for each such coil with the lead wires threaded through holes in the winding tube, whereupon the tube was rotated to simultaneously form several coils and thereafter the tube sectioned to separate individual coils. An alternate approach to the individual lead wires was simply to bring the magnet wire directly out of the coil. In either case, the wires can become tangled, broken or cut off while handling the assembly or while cutting the tube to separate individual coils. Coils formed by this general technique are known in the art as stick wound coils.

SUMMARY OF THE INVENTION

Among the several objects of the present invention may be noted the provision of a process to make the assembly of stick wound coils faster or easier and to make the interconnection of individual coils to external devices easier and more reliable; the provision of a fabrication technique which avoids handling problems associated with the prior art coil leads; the provision of a method for forming coils which facilitates the subsequent connection of external leads to a completed coil; the provision of a coil forming technique which facilitates the simultaneous winding of a multiplicity of coils; the provision of a pad on a coil form to which coil wire may be attached preparatory to winding a coil on that form; and the provision of a process which reduces the overall cost of forming and utilizing coils. These as well as other objects and advantageous features of the present invention will be in part apparent and in part pointed out hereinafter.

In general, a plurality of coils of wire are concurrently formed by providing an elongated coil form of insulating material with a first conductive strip along a substantial portion of the coil form in the direction of elongation with connection tabs extending therefrom through the surface of the coil form. A plurality of first wire ends from a plurality of wire sources are connected to the strip surface. A plurality of coils, one from each source, are then simultaneously wound about the coil form and a second conductive strip, similar to the first strip, may be disposed along the outer surface of each of the wound coils for connecting second wire ends. Thereafter individual coils are severed from the other coils for subsequent use.

Also in general and in one form of the invention, a form for concurrently winding a plurality of coils includes an elongated hollow coil form of insulating material having a plurality of openings spaced along the form and in the direction of elongation. A conductive strip extends along one surface of the coil form in the direction of elongation and has a plurality of conductive tabs extending therefrom, each through a corresponding one of the coil form openings into the hollow interior thereof. The conductive strip may include a plurality of relatively wider sections upon which coils are to be wound, separated by intermediate relatively more narrow sections along which the form is to be cut upon completion of the winding of the coils.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 4:
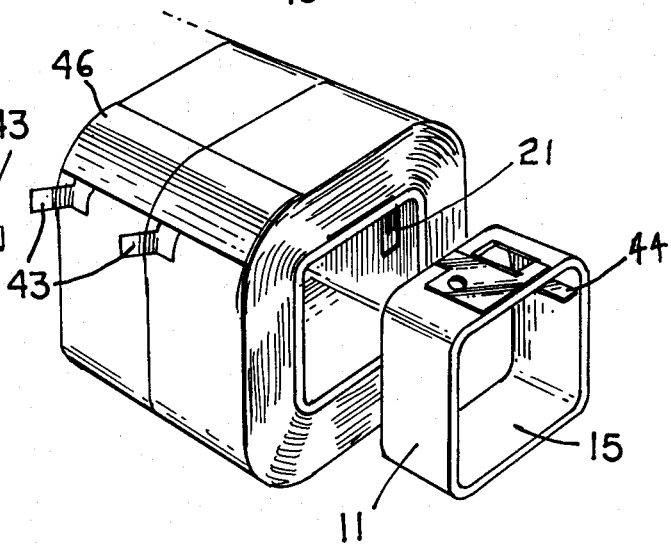
FIG. 4 is a perspective view of a plurality of completed coils.

Referring now to the drawing generally, a plurality of coils, as illustrated in FIG. 4, are concurrently formed about an elongated coil form 11 of insulating material of, for example, cardboard or the like, with this coil form being a generally hollow tubular configuration with a plurality of holes, such as 13, arranged along one surface and extending in the direction of elongation. Each hole 13 communicates with the hollow opening 15 of the coil form. A first conductive strip 17, having a plurality of upstanding tabs, such as 19 and 21, has each of its tabs aligned with a corresponding coil form opening, and the form 11 and strip 17 are juxtaposed by passing the tab portions into the openings until the strip abuts the coil form with the several tabs extending about half way through the hollow interior 15 of the coil form. Conductive strip 17 is then temporarily held in position disposed along the coil form by applying tape 23 and 25 over the juxtaposed combination near each strip end.

A plurality of first wire ends 27, 29 and 31 from a like plurality of wire sources are connected to the strip 17, for example by soldering each wire end to the strip. This soldering may be accomplished prior to severing the previously completed coil set from the plurality of wire sources and the wire sections between the new coil form, and prior coils thereafter simply broken or cut away by an operator, if desired. There are, of course, as many wires ends and wire sources as coils to be simultaneously formed. A protective insulating strip 37 may next be placed over the conductive strip 17 to insure that the conductive metal strip 17 does not damage the insulation on the first or innermost coil layer, as the coils are formed.

The coil form 11, conductive strip 17, insulating or protecting strip 37, and attached wire ends, are then revolved, generally about the axis of elongation of the coil form, with the several wire leads from the respective wire sources being guided so as to layer wind the plurality of coils. Further strips of insulating material in the form of paper like insulating layers may be periodically interposed to isolate each coil layer from the succeeding coil layer.

Upon completion of the winding process, a further protective insulating strip 39 is applied along the outer surface of each of the wound coils and thereafter a second conductive strip 41 is disposed along the coils, again in the general direction of coil form elongation to provide terminals for connecting the respective coil leads at the outer periphery of the several coils. Strip 41 will be configured substantially the same as strip 17 and will include conductive tabs 43 upstanding from the strip surface, which tabs provide a second terminal for connecting the coil in its intended environment. This outer strip 41 may be held in position by wrapping the coils with tape or by an axial strip of protective tape 46 and of course has the leads from the outer coil layers connected thereto, for example by soldering, as previously described.

Figure 3:
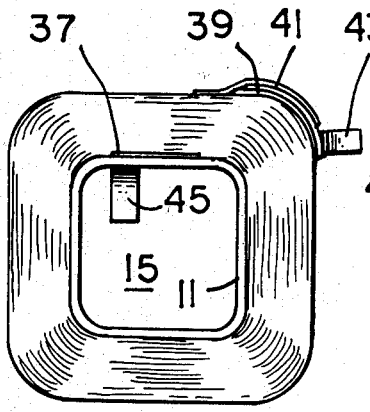
FIG. 3 is an end view of a completed coil as seen in the direction of coil form elongation.

Either immediately before or immediately after the soldering of the wire leads to the outer strip 41, the coil leads are cut from their respective wire sources to free the stick wound coil assembly therefrom. Individual coils may then be severed from other of the coils in the assembly by a slicing or cutting operation generally along a plane perpendicular to the axis of elongation of the coil form and, of course, lying between adjacent coils on the form. This cutting or slicing operation will sever outer strip 41 and any associated tape, protective strip 39, the several layers of insulating paper, protective strip 37, conductive strip 17 and the insulating tubular form 11. After slicing off an individual coil, its corresponding inner tab, such as 45 in FIG. 3, is normally bent from the position illustrated in FIG. 3 so that that tab extends in the direction of elongation of the original form and beyond the surface of the coil for ready attachment to other circuit components, as illustrated by tab 44 in FIG. 4. In FIG. 4, the coil associated with tab 44 has been omitted to more clearly illustrate the manner in which tab 44 is bent outwardly for ready attachment.

The conductive strips 17 and 41 are formed from a continuous strip of tin plated brass which is cut and bent to form the particular strip configuration illustrated. This means that the distance between successive conductive tabs, such as 19 and 21, will be about the same as the depth of penetration of those tabs into the hollow coil form interior, and in the illustrated environment, this is about one-half the width of the coil form opening 15. Actually the tabs, such as 19 and 21 will extend into the coil form interior somewhat less than the distance separating those two consecutive tabs by the coil form 11 wall thickness and the thickness of the small segment 47 which remains in the plane of the main portion of strip 17.

Figure 1:
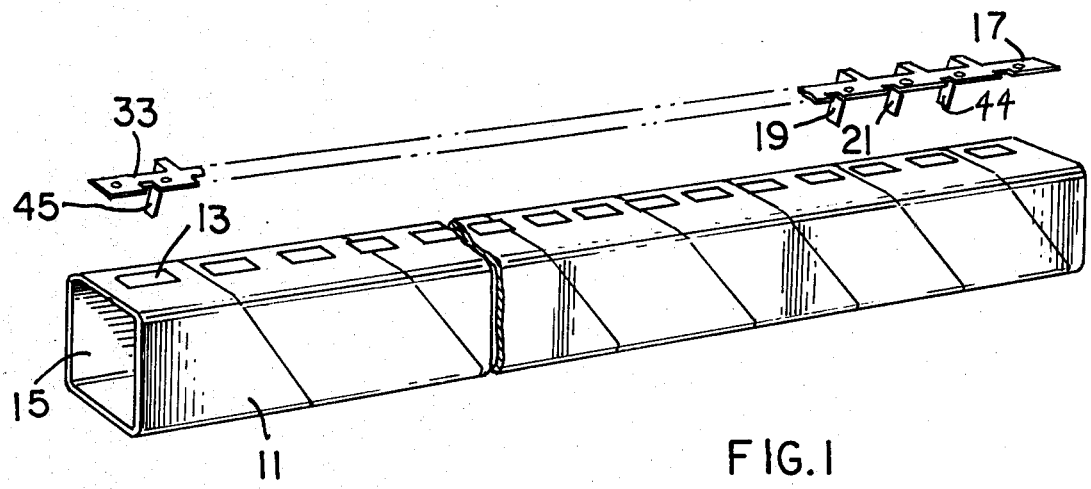
FIG. 1 is a perspective view of an elongated coil form with a tabbed conductive strip ready to be disposed therealong.
Figure 2:
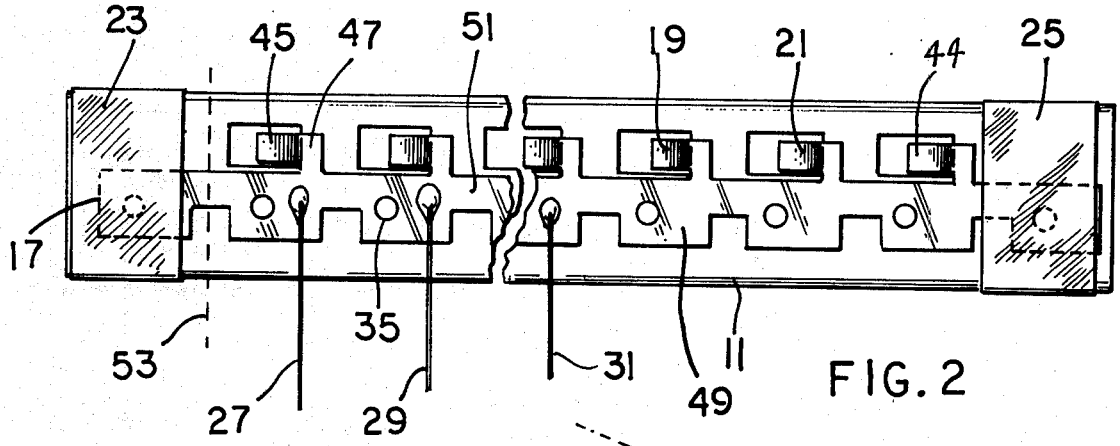
FIG. 2 is a plan view of the coil form and conductive strip of FIG. 1, joined together with exemplary wire ends connected to the strip.

As best seen in FIG. 2, the conductive strip 17 is seen to include a plurality of relatively wider sections 49, including the soldering pad portion of the strip upon which the coils are to be wound, separated by intermediate relatively more narrow sections, such as 51, along which the form is to be cut upon completion of the winding of the coils. The length of the conductive tab should be less than the width of the opening 15 in the coil form, and as noted earlier, is frequently about one-half this width. The hole, such as 13, in the cardboard tube or coil form 11, should be relatively close to the edge of the finished coil so as to allow the tab to be bent outwardly and extend past the coil edge, as illustrated in FIG. 4, by an amount sufficient to be useful for subsequent circuit connecting purposes. Of course, the hole, such as 13, in the form must not be so close to the edge of the finished coil as to unduly weaken the coil. These factors should all be considered when determining the location and size of the holes 13, as well as the general cleavage line 53, along which two adjacent coils are to be separated.

Holes, such as 35, are used during the manufacture of the strip to aid in moving the strips through cutting and forming dies.

From the foregoing it is now apparent that a novel method of forming a plurality of coils of wire, as well as a novel coil form arrangement have been disclosed meeting the objects and advantageous features set out hereinbefore as well as others and that modifications as to the precise configurations, shapes and details may be made by those having ordinary skill in the art without departing from the spirit of the invention or the scope thereof as set out by the claims which follow.

What is claimed is:

1. The method of concurrently forming a plurality of coils of wire comprising the steps of:

providing an elongated hollow coil form of insulating material having an opening extending therethrough in the direction of elongation, the coil form arranged to have a plurality of holes along one surface in the direction of elongation, each hole communicating with the hollow opening;

disposing a first conductive strip along a substantial portion of the coil form in the direction of elongation by passing a like plurality of conductive tab portions of the first conductive strip through respective holes and into the coil form opening;

connecting a plurality of first wire ends from a like plurality of wire sources in the first conductive strip;

simultaneously winding a like plurality of coils, one from each source, about the coil form;

disposing a second conductive strip in the direction of elongation along an outer surface of each of the wound coils;

connecting second wire ends of each of the plurality of coils to the second conductive strip; and severing individual coils from other of the coils for subsequent use.

2. The method of claim 1 including the further step of bending each tab portion after the severing step so that the tab portion of each severed coil extends generally in the direction of elongation and beyond a side surface of the severed coil.

3. The method of claim 1 including the further step of applying a protective layer over the first conductive strip after the plurality of first wire ends are connected thereto and prior to the step of simultaneously winding.

4. The method of claim 1 including the further step of applying a protective strip along the outer surface of each of the wound coils prior to disposing the second conductive strip to protect the coils from damage by the conductive strip.

5. The method of claim 1 wherein the step of disposing the first conductive strip includes juxtaposing the first strip and coil form, and applying tape over the juxtaposed combination near each first strip end.

6. The method of claim 5 wherein the step of juxtaposing includes aligning a plurality of conductive strip tab portions with a like plurality of coil form surface openings, and passing the tab portions into the openings until the first strip abuts the coil form.

7. The method of claim 1 wherein the step of disposing includes aligning a plurality of conductive strip tab portions with a like plurality of coil form surface openings and passing the tab portions into the openings until the first strip abuts the coil form.

8. The method of concurrently forming a plurality of coils of wire comprising the steps of:

providing an elongated hollow coil form of insulating material having a plurality of openings along the form in the direction of elongation;

disposing a conductive strip having a plurality of upstanding tabs along a substantial portion of the coil form in the direction of elongation with each tab passing through a corresponding coil form opening and extending a substantial distance into the coil form hollow to provide terminals to which subsequent electrical connection may be made;

connecting a plurality of wire ends from a like plurality of wire sources to the conductive strip;

simultaneously winding a like plurality of coils, one from each source, about the coil form; and severing individual coils from other of the coils for subsequent use.

9. The method of claim 8 wherein the step of simultaneously winding includes revolving the coil form about an axis which extends in the general direction of elongation.

10. The method of claim 8 wherein each connecting step is performed by soldering a respective wire end to a conductive strip.

11. The method of claim 8 wherein each of the coils is layer wound, the step of simultaneously winding including periodically interposing a sheet of insulating material common to each coil in the plurality for insulating coil layers from adjacent layers within the same coil.

12. The method of claim 11 wherein the step of severing includes cutting the conductive strip, layers of sheet insulating material and coil form generally normal to the direction of elongation.

13. The method of claim 8 including the further step of applying a protective layer over the conductive strip after the plurality of first wire ends are connected thereto and prior to the step of simultaneously winding.

14. The method of claim 8 wherein the step of disposing the conductive strip includes juxtaposing the strip and coil form, and applying tape over the juxtaposed combination near each strip end.

* * * * *

UNITED STATES PATENT AND TRADEMARK OFFICE

CERTIFICATE OF CORRECTION

PATENT NO. : 4,347,659

DATED : September 7, 1982

INVENTOR(S) : Richard L. Dalton, Jr.

It is certified that error appears in the above—identified patent and that said Letters Patent is hereby corrected as shown below:

Col. 3, line 10 "away" omitted between "cut" and "by"

Col. 4, line 32 "strip" should be -- strips --.

Claim 8, Col. 5 line 32 "spaced" omitted between "openings and "along"

Signed and Sealed this

Fourth Day of January 1983

[SEAL]

*Attest:*

GERALD J. MOSSINGHOFF

*Attesting Officer*

*Commissioner of Patents and Trademarks*